US009101814B2

(12) United States Patent
Beatty

(10) Patent No.: US 9,101,814 B2
(45) Date of Patent: Aug. 11, 2015

(54) METHOD AND APPARATUS FOR CYCLING TRAINING

(71) Applicant: Alfred C. Beatty, Broomall, PA (US)

(72) Inventor: Alfred C. Beatty, Broomall, PA (US)

( * ) Notice: Subject to any disclaimer, the term of this patent is extended or adjusted under 35 U.S.C. 154(b) by 79 days.

(21) Appl. No.: 14/038,075

(22) Filed: Sep. 26, 2013

(65) Prior Publication Data

US 2014/0087924 A1 Mar. 27, 2014

Related U.S. Application Data

(60) Provisional application No. 61/705,885, filed on Sep. 26, 2012, provisional application No. 61/705,628, filed on Sep. 26, 2012.

(51) Int. Cl.

| | |
|---|---|
| ***A63B 22/06*** | (2006.01) |
| ***A63B 69/16*** | (2006.01) |
| *A63B 69/00* | (2006.01) |

(52) U.S. Cl.

CPC ..... *A63B 69/16* (2013.01); *A63B 2069/0062* (2013.01); *A63B 2208/0209* (2013.01); *A63B 2210/50* (2013.01)

(58) Field of Classification Search

CPC .... A63B 22/06; A63B 22/0605; A63B 69/16; A63B 2069/161–2069/168; A63B 2208/0209

See application file for complete search history.

(56) References Cited

U.S. PATENT DOCUMENTS

| | | | | |
|---|---|---|---|---|
| 592,093 | A | 10/1897 | Law | |
| 2,043,977 | A | 6/1936 | Back | |
| 3,352,426 | A | 11/1967 | Carlson | |
| 3,368,809 | A * | 2/1968 | Duane | 482/61 |
| 3,866,908 | A | 2/1975 | Hangler | |
| 4,262,899 | A * | 4/1981 | Alvarez | 482/61 |
| D273,882 | S | 5/1984 | Bryne | |
| 4,466,797 | A | 8/1984 | Ray | |
| 4,938,475 | A | 7/1990 | Sargeant | |
| 4,955,600 | A | 9/1990 | Hoffenberg | |
| 5,382,208 | A | 1/1995 | Hu | |
| 5,967,946 | A | 10/1999 | Beatty, Jr. | |
| 2003/0027692 | A1 * | 2/2003 | Phillips | 482/57 |

FOREIGN PATENT DOCUMENTS

| | | |
|---|---|---|
| FR | 2424747 | 11/1979 |
| GB | 2151562 | 7/1985 |

* cited by examiner

*Primary Examiner* — Oren Ginsberg

(74) *Attorney, Agent, or Firm* — Stephen H. Eland; Dann, Dorfman, Herrell & Skillman

(57) ABSTRACT

A method and apparatus are provided for facilitating single-leg cycling training. The apparatus comprises a pair of legs connected to form a self-supporting structure that can be variably positioned relative to the rotational path of the pedals of a cycling device. One of the legs comprises a foot support configured to cooperate with a binding of a cycling shoe to support the foot while the other foot of the user is engaged with a pedal to perform single-leg training. The foot support comprises a pair of spaced apart rows of sockets configured to support the ends of a support rod. During use, the user places a foot on the support rod.

19 Claims, 4 Drawing Sheets

METHOD AND APPARATUS FOR CYCLING TRAINING

PRIORITY CLAIM

The present invention claims priority under §119 to U.S. Provisional Application Nos. 61/705,885 and 61/705,628 both filed Sep. 26, 2012. The entire disclosure of each of the foregoing applications is hereby incorporated herein by reference.

FIELD OF THE INVENTION

The present invention relates to the field of training devices. In particular the present invention relates to a method and apparatus for cycling training. In particular, the present invention relates to a method and apparatus for facilitating single-leg training in connection with a bicycle.

BACKGROUND OF THE INVENTION

The use of stationary bicycles for cycling training is well known in the art. A typical design incorporates a bicycle mounted on a training device that supports the rear wheel of the bicycle. Often, the rear wheel support provides some type of resistance when the rider pedals the bicycle. Typically, the rider pedals the bicycle with two legs, however, to improve to target and develop leg-lifting muscles, users may desire to incorporate single-leg training into their routine. For single-leg training, the rider removes a foot from one of the pedals and pedals the bicycle with one leg. However, supporting the stationary leg during single-leg training can be awkward and/or cumbersome. Accordingly, there exists a need for an efficient device for facilitating single-leg cycling training.

SUMMARY OF THE INVENTION

In light of the shortcomings of the known devices, the present invention provides a method and apparatus to facilitate single-leg cycling training. According to one aspect of the present invention, a method for forming a training apparatus is provided. A generally rectangular blank is formed from a sheet of generally rigid material having a front face. A plurality of parallel spaced apart notches are cut from the sheet to form two rows of spaced apart notches. An area between the rows of notches is cut-out to form an aperture sufficiently sized to accommodate a bicycle shoe. The blank is then bent so that the notches project away from the front face of the blank. The blank is the bent to form a generally A-frame self-supporting structure.

According to another aspect of the present invention, an apparatus for facilitating single-leg cycling training when a user is on a cycling device having pedals is provided. The apparatus comprises first and second legs that intersect to form a self-supporting structure. The second leg has a width and a foot support. The foot support comprises first and second rows of vertically spaced apart sockets. The first and second rows are spaced apart from one another across the width of the second leg. The sockets of the first row are generally vertically aligned with corresponding sockets of the second row. The apparatus further includes an elongated support rod having a sufficient length to span from the first row of sockets to the second row of sockets.

According to yet another aspect of the present invention, a cycling training apparatus is provided that includes a cycling device and a foot support assembly displaceable laterally and longitudinally relative to the cycling device.

BRIEF DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 1:
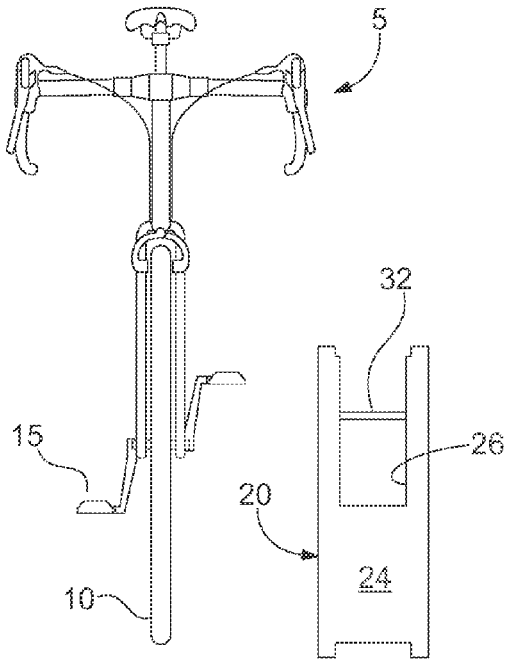
FIG. 1 is a front view of a cycling training apparatus shown in connection with a bicycle.

Referring now to the figures, wherein like elements are numbered alike throughout, an apparatus for cycling training is designated generally 20. The device 20 is operable in connection with a bicycle 5 to facilitate single-leg bicycle training. As shown in FIG. 1, the device 20 is positioned adjacent the front wheel 10 of the device. The device 20 is self-supporting relative to the bicycle so that the device can be positioned forwardly and laterally relative to the pedals to accommodate various user preferences for support during single-leg training.

Figure 2:
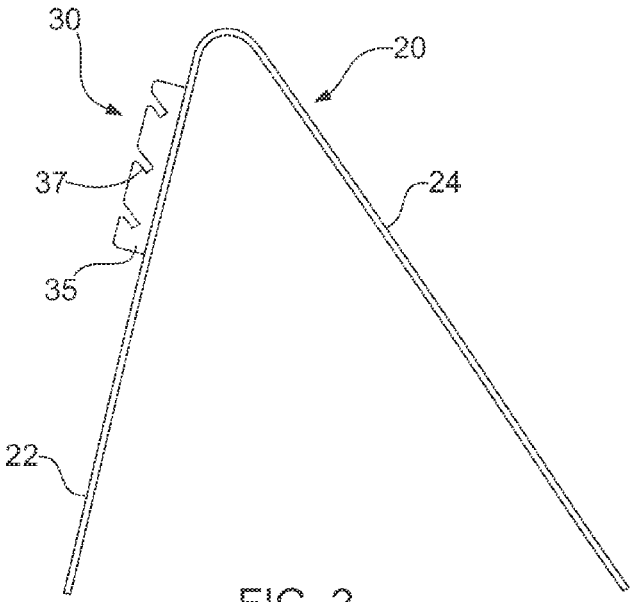
FIG. 2 is an enlarged side view of the cycling training apparatus shown in FIG. 1.

Referring to FIGS. 1-2, the device comprises an A-frame shaped structure having a front leg 22 and a rear leg 24. The two legs 22, 24 intersect at an angle to form a self-supporting generally upright A-frame structure. Alternatively, the two legs may be releasably connectable or can be connected by and intermediate arm to form a H-shaped free-standing structure.

Figure 3:
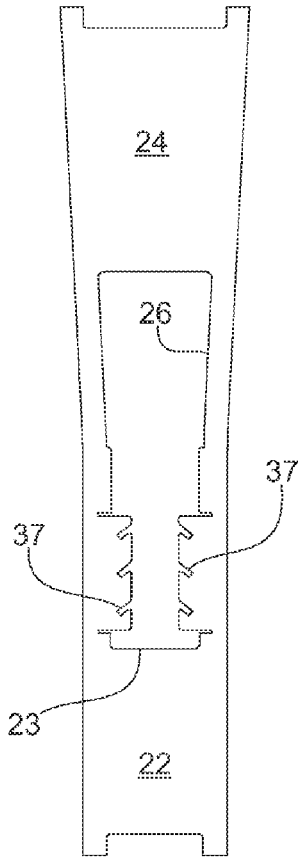
FIG. 3 is a plan view of the cycling training apparatus of FIG. 2 partially formed.

In the present instance, the forward leg comprises a clip support 30 to cooperate with a clipless binding on a cycling shoe. For instance, in the present instance, the clip support comprises an elongated bar or rod 32 and a mechanism for supporting the rod. For instance, in the present instance, a rod holder comprising first row of sockets 37 laterally spaced apart from a second row of sockets 37. The sockets may be configured in a variety of shapes. For instance, the sockets 37 may comprise a plurality of spaced apart notches formed in the front leg 22 of the device 20 as shown in FIGS. 2-3. The support 32 engages a pair of the spaced-apart notches and spans the distance from one notch to a corresponding notch so that the rod is supported in a generally horizontal orientation as shown in FIG. 6.

Figure 4:
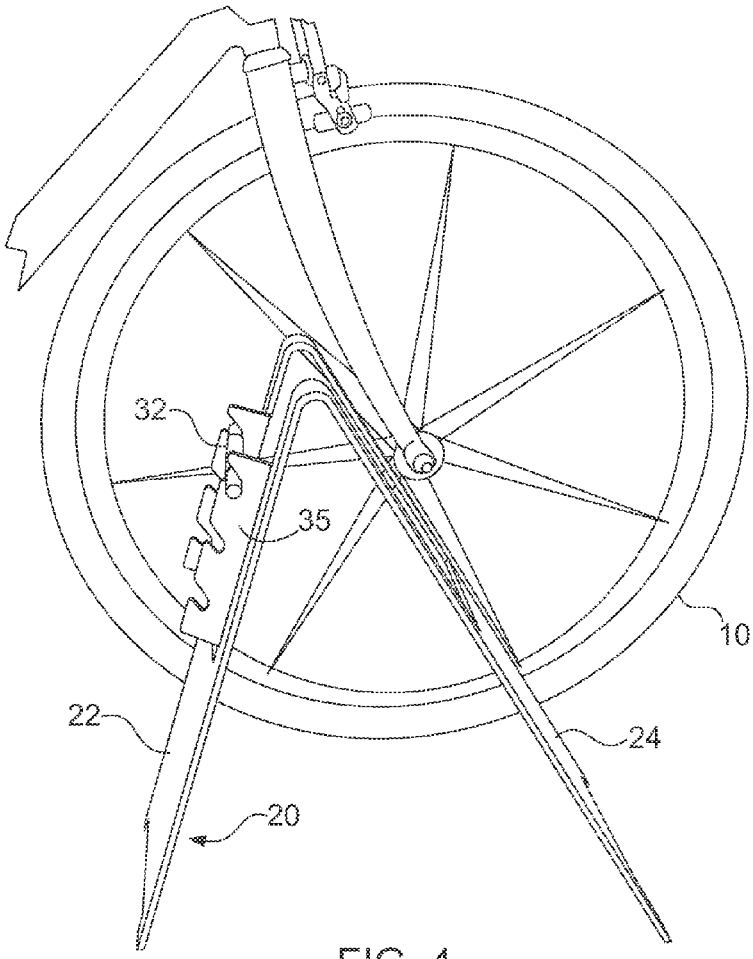
FIG. 4 is a side perspective view of the cycling training apparatus shown in combination with a bicycle.
Figure 5:
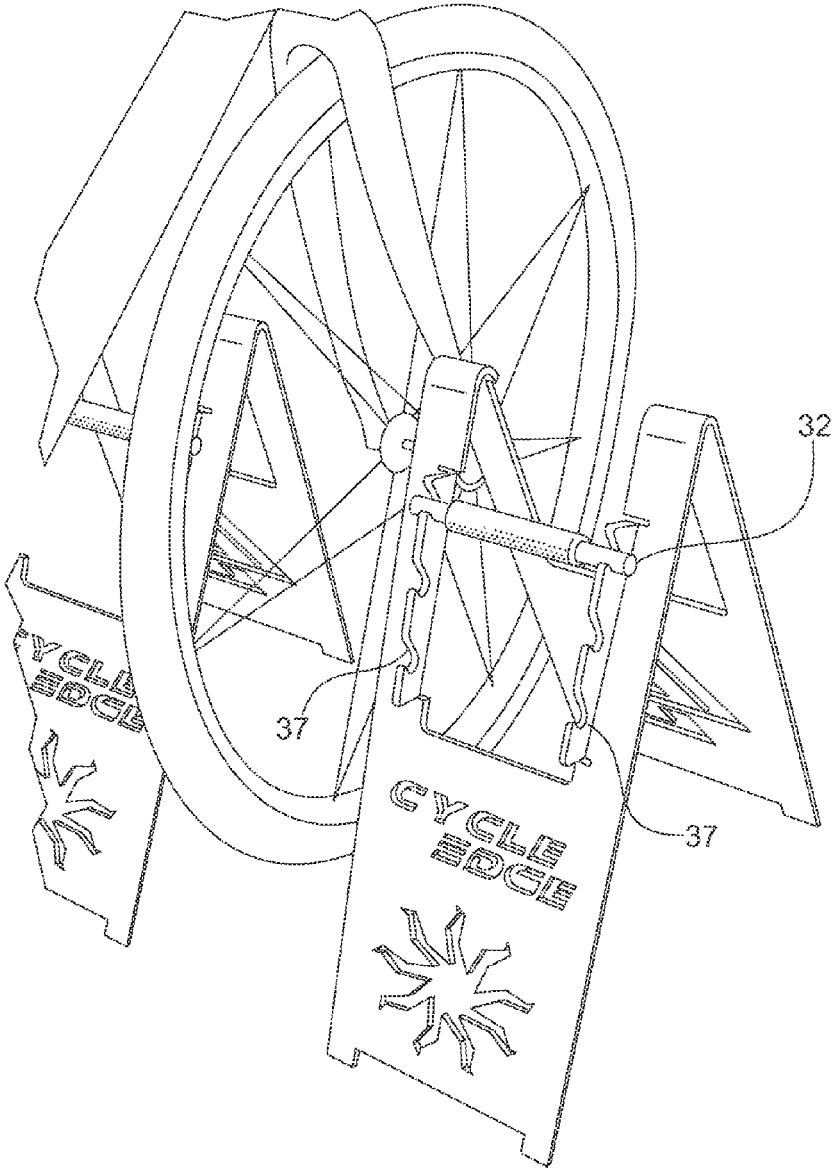
FIG. 5 is a perspective view of the cycling training apparatus of FIG. 1 shown in combination with a bicycle.

The rod 32 may be a cylindrical rod having a circular cross-section as shown in FIGS. 4-5. Alternatively, the rod 32 may have a non-circular cross-section, such as a rectangular cross section, as shown in FIGS. 2-3 and 6. By using a non-circular cross-section, the notches and rod cooperate to impede rotation of the rod 32 during use.

As shown in FIG. 2, the rod support 35 comprises a plurality of notches or slots 37. Each slot comprises a pair of generally parallel faces, and the bottom of the slot comprises a profile to mate with the outer surface of the rod 32. For instance, referring to FIG. 2, the bottom of each slot comprises a pocket having a generally flat bottom and two sidewalls extending generally normal to the bottom to form a pocket that mates with a rectangular cross-sectional rod.

Figure 6:
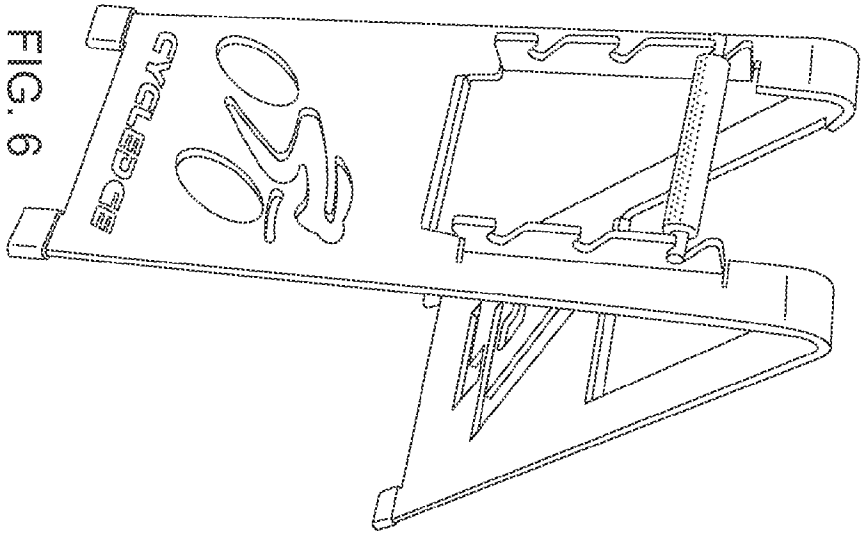
FIG. 6 is a perspective view of the cycling training apparatus of FIG. 5 without the bicycle.

Referring to FIG. 4-6, the front leg 22 includes a cut-out adjacent the clip support 30. In this way, the user can places a foot onto the clip support and the user's foot can project into the open space provided by the cut-out. Similarly, in the present instance, the rearward leg 24 further comprises a cut-out 26 aligned with at least a portion of the cut-out 23 in the front leg 22.

Referring to FIG. 3, the device may be formed as follows. A sheet of material, for example a metal such as aluminum is formed into a generally rectangular shape to form a blank. Tabs forming feet may be cut or formed into the ends of the blank, which will be the feet of the front and rear legs. The cut-outs 23, 26 are cut or punched from the flat blank. When the front cut-out 23 is formed, the notches 37 of the rod holder are cut-out as well. At this point, the blank looks substantially similar to FIG. 3.

The rod holder 35 is then formed by bending the portion of the blank comprising the first row of sockets 37 outwardly transverse the face of the first leg 22. The portion of the blank comprising the second row of sockets 37 is then bent outwardly transverse the face of the first leg, so that the first row of sockets opposes the second row of sockets. In this way, the rod holders 35 project away from the face of the front leg 22, as shown in FIG. 2. The blank is then bent into a generally A-frame shape as shown in FIG. 2. In the present instance, the blank is bent so that the front face is generally more vertical than the rearward leg. For instance, the forward leg may be approximately 80 degrees from horizontal, while the rear leg may be approximately 60 degrees from horizontal.

The device 20 is independently positionable relative to a cycling device, such as a cycling device having a pair of pedals mounted on a pair of crank arms that rotate about a crank axis. In the present instance, the cycling device 5 includes a seat, handle bars and a pair of wheels. However, the device 20 may be operable in connection with a cycling device such as a stationary cycle.

Additionally, in the present instance, the as the crank arms rotate about the crank axis, the pedals follow a path. The device 20 may be positioned so that the support rod 32 is longitudinally aligned with the path of the pedal. Alternatively, the device can be displaced laterally so that the support rod is laterally spaced from the longitudinal axis defined by the path of the pedal. Further still, the support rod may be moved longitudinally toward or away from the path of the pedal depending on the preference of the user.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A method for forming a training apparatus for use in combination with a bicycle, comprising the steps of:

forming a generally rectangular blank from a sheet of generally rigid material having a front face;

cutting a plurality of parallel spaced apart notches, to form two rows of spaced apart notches;

cutting out an area between the rows of notches sufficient to accommodate a bicycle shoe;

bending the blank so that the notches project away from the front face of the blank; and bending the blank to form a generally A-frame self-supporting structure.

2. The method of claim 1 comprising the step of inserting a clip supporting element into the notches so that a user can place a bicycle shoe on the clip supporting element to support the bicycle shoe above the ground.

3. The method of claim 2 wherein the step of inserting a clip supporting element comprises inserting a bar into a pair of notches so that the bar straddles the pair of notches.

4. The method of claim 3 wherein the bar comprises a polygonal cross-section configured to cooperate with a bike shoe binding.

5. An apparatus for facilitating single-leg cycling training when a user is on a cycle having pedals, comprising:

a first leg;

a second leg intersecting the first leg at an angle to form a self-supporting structure, wherein the second leg has a width and the second leg comprises a foot support, comprising:

a first row of vertically spaced apart sockets having an interior configuration;

a second row of vertically spaced apart sockets having an interior configuration, wherein the first and second rows of sockets are spaced apart from one another across the width of the second leg, and wherein the sockets of the first row are generally vertically aligned with corresponding sockets of the second row;

an elongated support rod having a profile configured to cooperate with the sockets of the first and second rows of sockets, and wherein the support rod has a sufficient length to span from the first row of sockets to the second row of sockets so that a first end of the rod can be supported by one of the sockets in the first row while a second end of the rod can be supported by one of the sockets in the second row.

6. The apparatus of claim 5 wherein the profile of the rod and the sockets are configured to impede rotation of the rod relative to the sockets when the rod is inserted into two of the sockets.

7. The apparatus of claim 5 wherein the second leg comprises an aperture between the two rows of sockets, wherein the aperture is sized to allow a foot of the user to project into the aperture when the user's foot is placed onto the support rod.

8. The apparatus of claim 5 wherein the rod is configured to engage a clipless binding on the bottom of cycling shoe.

9. The apparatus of claim 5 wherein the support rod is generally horizontal when the rod is inserted into one of the sockets in the first row and one of the sockets in the second row.

10. The apparatus of claim 5 wherein the first and second legs are integrally formed from a single piece of material, and wherein the material is metal bent to form the first and second legs.

11. The apparatus of claim 5 wherein the first and second row of sockets project outwardly away from a face of the second leg.

12. The apparatus of claim 5 wherein the first and second legs are generally vertical and the first and second legs intersect to form an A-frame structure.

13. A cycling training apparatus, comprising:

a cycling device comprising a seat, handle bars and a pair of pedals positioned at the end of a pair of rotatable crank arms rotatable around a crank axis, wherein each pedal defines a path of rotation as the crank arms are rotated around the crank axis;

a foot support assembly independently positionable relative to the cycling device so that the foot support assembly is positionable in alignment with a path of rotation of one of the pedals, or laterally offset from the path of rotation, wherein the foot support assembly is spaced apart from the cycling device so that neither of the pedals intersect the foot support when the crank arms are rotated about the crank axis, wherein the foot support assembly comprises:

a first leg projecting upward;

a second leg intersecting the first leg at an angle to form an A-frame structure, wherein the second leg has a width and the second leg comprises a foot support, comprising:

a first row of vertically spaced apart sockets having an interior configuration;

a second row of vertically spaced apart sockets having an interior configuration, wherein the first and second rows of sockets are spaced apart from one another across the width of the second leg, and wherein the sockets of the first row are generally vertically aligned with corresponding sockets of the second row;

an elongated support rod having a profile configured to cooperate with the sockets of the first and second rows of sockets, and wherein the support rod has a sufficient length to span from the first row of sockets to the second row of sockets so that a first end of the rod can be supported by one of the sockets in the first row while a second end of the rod can be supported by one of the sockets in the second row.

14. The apparatus of claim 13 wherein the cycling device comprises a front wheel and a rear wheel and the apparatus comprises a support for maintaining the cycling device upright and the rear wheel off of the ground.

15. The apparatus of claim 13 wherein the foot support assembly is laterally displaceable relative to the cycling device.

16. The apparatus of claim 13 wherein the profile of the rod and the sockets are configured to impede rotation of the rod relative to the sockets when the rod is inserted into two of the sockets.

17. The apparatus of claim 13 wherein the second leg comprises an aperture between the two rows of sockets, wherein the aperture is sized to allow a foot of the user to project into the aperture when the user's foot is placed onto the support rod.

18. The apparatus of claim 13 wherein the rod is configured to engage a clipless binding on the bottom of cycling shoe.

19. The apparatus of claim 13 wherein the support rod is generally horizontal when the rod is inserted into one of the sockets in the first row and one of the sockets in the second row.

* * * * *